United States Patent [19]

Murakami

[11] Patent Number: 4,754,203

[45] Date of Patent: Jun. 28, 1988

[54] METHOD FOR DRIVING A GAS-DISCHARGE DISPLAY PANEL

[75] Inventor: Hiroshi Murakami, Tokyo, Japan

[73] Assignee: Nippon Hoso Kyokai, Tokyo, Japan

[21] Appl. No.: 322,982

[22] Filed: Nov. 19, 1981

[30] Foreign Application Priority Data

Nov. 20, 1980 [JP] Japan ..... 55-162709

[51] Int. Cl.[4] ..... H01J 61/66

[52] U.S. Cl. ..... 315/169.4; 315/169.1

[58] Field of Search ..... 315/169.4, 169.2, 169.1, 315/168; 340/776, 775, 805

[56] References Cited

U.S. PATENT DOCUMENTS

| | | | |
|---|---|---|---|
| 3,626,235 | 12/1971 | Kupsky | 315/169.4 X |
| 4,030,091 | 6/1977 | Ngo | 340/776 X |
| 4,099,096 | 7/1978 | Holz et al. | 340/776 |
| 4,140,945 | 2/1979 | Trogdon | 315/169.4 X |

FOREIGN PATENT DOCUMENTS

| | | | |
|---|---|---|---|
| 51-147216 | 12/1976 | Japan | 315/169.4 |

*Primary Examiner*—David K. Moore

*Attorney, Agent, or Firm*—Parkhurst & Oliff

[57] ABSTRACT

A gas-discharge display panel comprising a matrix of plural pairs of display discharge cells and auxiliary discharge cells individually provided with three electrodes, one of which is common to both cells, is driven by a discharge sustaining pulse train, pairs of discharge starting pulses and pairs of discharge eliminating pulses, which pairs of pulses are applied respectively to two electrodes in the display discharge cell under the sequential application of scanning pulses to the auxiliary discharge cells and a time duration between the applications of which pairs determines the displayed brightness and further which pairs are applied at intervals of the discharge sustaining pulses with the least necessary pulse height and pulse width. As a result, a picture having sufficiently dark and bright levels can be efficiently displayed under the quick response with the least power consumption and the long life.

6 Claims, 3 Drawing Sheets

METHOD FOR DRIVING A GAS-DISCHARGE DISPLAY PANEL

BACKGROUND OF THE INVENTION (1) Field of the Invention

The present invention relates to a method for driving a gas-discharge display panel comprising a matrix of picture elements consisting of pairs of display discharge cells and auxiliary discharge cells provided individually with three electrode, one of which is common to both cells, a pulse train having predetermined intervals and pulse widths being continuously applied between electrodes of the display discharge cells, so as to sustain a once started sequence of pulse discharge until a discharge climinating pulse is applied thereto.

(2) Description of the Prior Art

A typical method for driving a gas-discharge display panel of the above kind, in each picture element of which a display anode, a holed cathode and an auxiliary anode are stacked in order, has been disclosed by the present applicant. According to this driving method, driving pulses having such waveforms as shown in FIG. 1 are applied to those electrodes respectively. That is, the display anode A is continuously applied with a discharge sustaining pulse train having a pulse width $\tau$, a pulse height $V_{AS}$ and an interval T, and, when a picture information is to be displayed by starting a gas-discharge in the display discharge cell, the cathode K and the auxiliary anode A' are simultaneously applied with a negative pulse having a pulse height $V_{KF}$ and a positive pulse having a pulse height $V_{A'F}$ respectively at an interval $T-\tau$ which does not contain the discharge sustaining pulse, so as to prevent the generation of erroneous discharges caused by the overlap of those pulses. In the display discharge cell, after the gas-discharge is continued by the discharge sustaining pulse during the duration $\tau$, this pulse gas-discharge is ordinarily stopped during the above interval $T-\tau$. However, charged particles generated by the pulse gas-discharge are not extinguished simultaneously with the stopping of the gas-discharge and hence are reserved in a certain time duration, so as to lower a re-ignition voltage of the discharge cell. Accordingly, another pulse gas-discharge is easily generated again by the succeeding discharge sustaining pulse under the appropriate selection of the length of the interval T, and, as a result, those pulse gas-discharges are repeated successively by each pulse of the discharge sustaining pulse train. The pulse height $V_{AS}$ and the pulse width $\tau$ of the discharge sustaining pulse are selected in such a manner that, when any preceding gas-discharge has not been caused in the display discharge cell, no pulse gas-discharge is generated, whilst, once any gas-discharge is generated, the aforesaid re-ignition phenomenon is caused, and further that, when the gas discharge is generated in the auxiliary discharge cell, a new gas-discharge can be started and sustained. Consequently, when the gas-discharge is generated in the auxiliary discharge cell by the pulses applied simultaneously to the cathode K and the auxiliary anode A', the sequence of the pulse discharges is started in the display discharge cell immediately after the auxiliary discharge is generated. That is, the entry of the picture information to be displayed, which is effected by the starting of the pulse discharge in the display discharge cell, is controlled by the starting of the gas-discharge in the auxiliary discharge cell.

On the other hand, when it is required to stop the sequence of pulse discharges continued by the discharge sustaining pulse train in the display discharge cell, the display anode A and the cathode K are simultaneously applied with a pair of discharge eliminating pulses having the pulse heights $V_{AE}$ and $V_{KE}$ respectively as shown in FIG. 1, so as to lower the effective voltage of the discharge sustaining pulse applied to the display discharge cell and hence to prevent the continuation of the aforesaid sequence of pulse discharges. Once the sequence of pulse discharges is discontinued as mentioned above, the pulse discharge cannot be regenerated by applying the discharge sustaining pulse having the pulse height $V_{AS}$ thereafter.

Regarding the above mentioned conventional method for driving the gas-discharge display panel, the elimination of gas-discharge does not cause any difficulty, whilst the entry of picture information and the sustenance of gas-discharge cause the following difficulties.

Regarding the waveforms of the driving pulses of various kinds as shown in FIG. 1, the possible range of the pulse height $V_{AS}$ of the discharge sustaining pulse should be set up as follows.

$$V_{fmin} > V_{AS} > V_{fpmax} \quad (1)$$

$$V_{AS} > V_{zmax} \quad (2)$$

where $V_{fmin}$ is the lowest among all of the gas-discharge cells of the discharge starting pulse voltages applied to the display discharge cells with the pulse width $\tau$, $V_{fpmax}$ is the highest among all of the gas-discharge cells of the discharge starting pulse voltages applied to the display discharge cells under the existence of the auxiliary discharge, and $V_{zmax}$ is the highest among all of the gas-discharge cells of the lowest pulse voltages $V_z$ required individually for sustaining the pulse discharges in the display discharge cells.

On the other hand, the pulse discharge of the aforesaid kind can be stably sustained without any current limiting resistor by reducing the pulse width $\tau$ as narrow as possible. However, when the pulse width $\tau$ is narrowed excessively such as a few micro seconds, the above voltage $V_{fpmax}$ cannot help being raised, even if under the existence of the auxiliary discharge, because a hole provided through the cathode for ionized coupling between cells is formed as small as possible for reducing the background brightness caused by the auxiliary discharge to the utmost. Particularly, when it is required to shorten the time taken for the entry of picture information such as in the display of television, the time taken for the auxiliary discharge is required to be shortened also, so that an insufficient amount of ionized particles generated by the auxiliary discharge can be diffused into the display discharge cell and hence the above voltage $V_{fpmax}$ is further raised. Consequently, it is necessary to determine the range of the above voltage $V_{fpmax}$ by the equation (1) alone, although it can be expected to be determined by both of those equations (1) and (2) as mentioned above. Moreover, it means to narrow the possible range of the voltage $V_{AS}$ that the amount of the term $V_{fpmax}$ is increased in the equation (1), and, as a result, it causes another difficulty such as the margin of the pulse height of the discharge sustaining pulse is reduced. In addition, the increase of the voltage $V_{AS}$ of the discharge sustaining pulse causes also the increase of the current of the pulse discharge, the loads impressed on the electrodes and the driving circuit thereof, as well as the excessive power consumption accompanied by the above may damage the display panel. Furthermore, in the gas-discharge display panel which employs the fluorescent material radiated by the excitation of the gas-discharge, the above increase of the discharge current causes still another difficulty such as the efficiency of the radiation thereof is lowered.

As described above in detail, the conventional method for driving the gas-discharge display panel has various defects such as the voltage range of the discharge sustaining pulse train is narrowed, as well as the pulse height thereof cannot help being raised and hence the increase of the discharge current accompanied thereby causes various kinds of injurious effects.

SUMMARY OF THE INVENTION

An object of the present invention is to provide a method for driving a gas-discharge display panel, whereby the above mentioned conventional defects are removed and hence the stable sequence of pulse discharges can be efficiently sustained.

Another object of the present invention is to enlarge the range of pulse height of a writing pulse used for the entry of picture information into the gas-discharge display panel, so as to stabilize the operation thereof as well as to prevent the raise of the dark level which is caused by the writing pulse.

The feature of the method for driving the gas-discharge discharge display panel according to the present invention is that, for driving a gas-discharge display panel comprising a matrix pairs of display discharge cells and auxiliary discharge cells, in each pair of which at least a common discharge electrode and a display and an auxiliary discharge electrodes disposed opposite to one another on each side thereof are provided, the display discharge electrode being applied with a discharge sustaining pulse train which has a pulse height, a pulse width and an interval being sufficient enough to sustain a once started display gas-discharge, as well as a discharge starting pulse voltage and a discharge eliminating pulse voltage being applied respectively between the electrodes provided in the display discharge cell and the auxiliary discharge cell, so as to display a picture, the discharge starting pulse voltage consists of a pair of voltage pulses having respective polarities opposite to each other and respective pulse widths, trailing edges thereof coinciding with each other, which pulses are applied respectively to the display discharge electrode and the common discharge electrode at the interval of the discharge sustaining pulse train, and among which pulses, the one applied to the display discharge electrode has the pulse height which does not exceed the height of the discharge sustaining pulse and the pulse width of which one does not exceed the pulse width of the other applied to the common discharge electrode.

BRIEF DESCRIPTION OF THE DRAWINGS

For the better understanding of the invention, reference is made to the accompanying drawings, in which.

DESCRIPTION OF THE PREFERRED EMBODIMENTS

Figure 2:
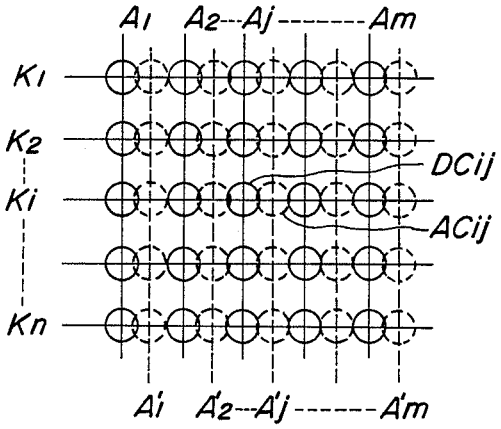
FIG. 2 is a diagram showing an outline of structure of a gas-discharge display panel to be operated according to a driving method of the present invention.

An example of an outline of structure of a gas-discharge display panel to be operated according to the driving method of the present invention is shown in FIG. 2. In this structure, a display discharge cell $DC_{ij}$ and an auxiliary discharge cell $AC_{ij}$ use a discharge electrode $K_i$ in common, as well as those cells use exclusively other discharge electrodes, namely, a display discharge electrode $A_j$ and an auxiliary discharge electrode $A'_j$ respectively. In general, the common discharge electrode $K_i$ is operated as a discharge cathode which is provided with a small hole formed therethrough for ionized coupling between cells, whilst the display discharge electrode $A_j$ and the auxiliary discharge electrode $A'_j$ are operated as a display discharge anode and an auxiliary discharge anode respectively.

Each of discharge cells constructed as mentioned above is operated as follows.

Figure 3:
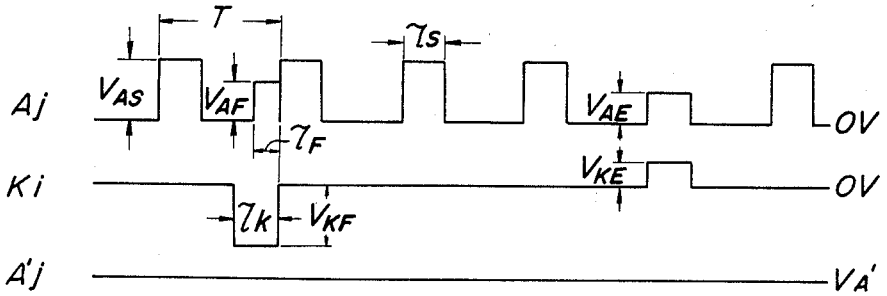
FIG. 3 is a diagram showing examples of waveforms representing a manner of operation of the same gas-discharge display panel.

The basic operation of arbitrary one $DC_{ij}$ of display discharge cells provided in the gas-discharge display panel is illustrated by the various waveforms as shown in FIG. 3.

Figure 1:
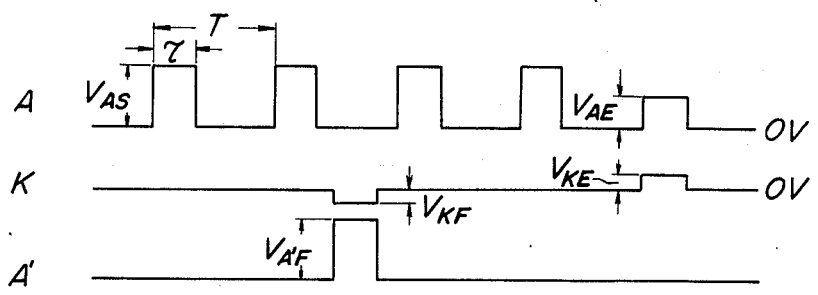
FIG. 1 PRIOR ART
FIG. 1 is a diagram showing signal waveforms representing a manner of operation of a gas-discharge display panel according to a conventional driving method.

The display discharge anode $A_j$ is applied always with a discharge sustaining pulse train having a pulse width $\tau_S$, a repetition interval T and a pulse height $V_{AS}$. These items of the pulse train should be set up to be sufficient enough to sustain the once started gas-discharge as mentioned earlier. However, in such a case as shown in FIG. 3, these items $\tau_S$, T and $V_{AS}$ can be set up so lower than those shown in FIG. 1 as it is not required that the display discharge can be started by the discharge sustaining pulse succeeding to the negative and the positive pulses $V_{KF}$ and $V_{A'F}$. The reason is that, once the display discharge is started by any procedure, ionized particles remaining thereafter facilitate the continuous generation of a sequence of pulse discharges sustained by the pulse train having the pulse height $V_{AS}$, the pulse width $\tau_S$ and the repetition interval T. Accordingly, it is required by the above reason that the pulse height $V_{AS}$ of the discharge sustaining pulse train satisfies the following condition.

$$V_{fmin} > V_{AS} > V_{Zmax} \quad (3)$$

As a result, when the entry of picture information is effected into the display discharge cell $DC_{ij}$, the discharge cathode $K_i$ and the display discharge anode $A_j$ are applied respectively with a negative pulse having a pulse width $\tau_K$ and a negative pulse height $V_{KF}$ ($V_{KF}<0$) and a writing pulse having a pulse width $\tau_F$ and a pulse height $V_{AF}$ during the interval of the discharge sustaining pulse train, those pulses being applied immediately before the discharge sustaining pulse. On the other hand, the auxiliary discharge anode $A'_j$ is always applied with a positive voltage $V_{A'}$, as well as the negative writing pulse $V_{KF}$ is applied to the cathode $K_i$, so that the resultant voltage $V_{A'}-V_{KF}$ is applied to the auxiliary discharge cell. When this resultant voltage $V_{A'}-V_{KF}$ exceeds the discharge starting voltage required for the auxiliary discharge cell, each of the auxiliary discharge cells $AC_{i1}, AC_{i2}, \ldots, AC_{im}$, which are arranged along the row direction, carry out the pulse discharge respectively once. On the other hand, only the display discharge anode $A_j$ is applied with the positive writing pulse having the pulse height $V_{AF}$, so that the display discharge cell $DC_{ij}$ is applied with the voltage $V_{AF}-V_{KF}$, whilst the other display discharge cells $DC_{i1}, DC_{i2}, \ldots, DC_{ij-1}, DC_{ij+1}, \ldots, DC_{im}$ are applied with the voltage $V_{KF}$ only.

Consequently, the following two conditions are required to be satisfied for exactly starting the gas-discharge of the display discharge cell $DC_{ij}$ only under the introduction of ionized particles generated by the gas-discharge of the auxiliary discharge cell.

$$V_{AF}-V_{KF}>V_{fpmax} \quad (4)$$

$$V_{KF}<V_{fpmin} \quad (5)$$

On the other hand, the other display discharge cells $DC_{1j}, DC_{2j}, \ldots, DC_{i-1j}DC_{i+1j}, \ldots, DC_{nj}$ arranged along the column direction are applied with the pulse having the pulse height $V_{AF}$, so that the following condition is required to be satisfied also.

$$V_{AF}<V_{fmin} \quad (6)$$

where $V_{fpmin}$ is the lowest among all of the gas-discharge cells of the discharge starting voltage of the display discharge cell under the existence of the auxiliary discharge.

According to the above conditions (4) and (6), the following condition can be derived.

$$V_{KF}+V_{fpmax}<V_{AF}<V_{fmin} \quad (7)$$

Figure 4:
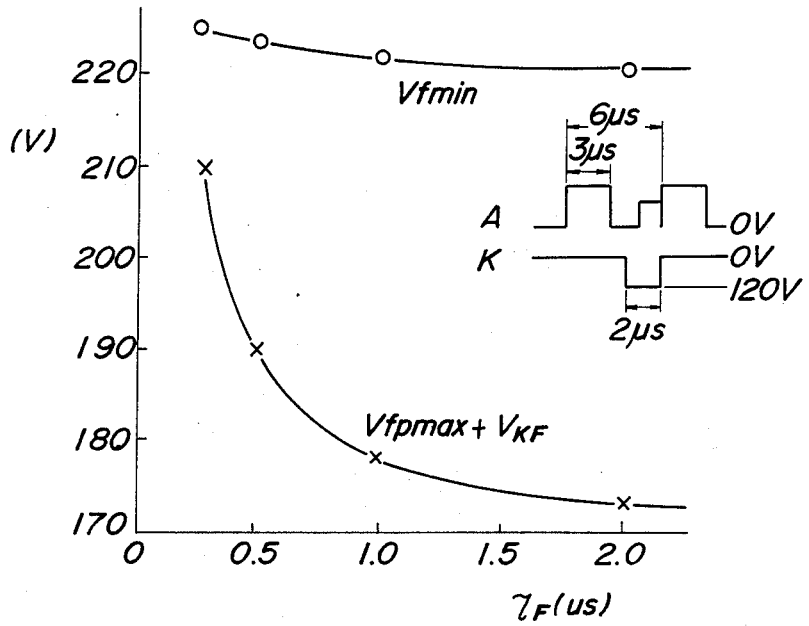
FIG. 4 is a diagram showing examples of characteristic curves representing the same manner of operation.

That is, although the equations (5) and (7) are required to be simultaneously satisfied for insuring the entry of only the display discharge cell $DC_{ij}$, it is very easy to set up the voltage $V_{KF}$ such as the equation (5) is satisfied by setting up the sufficiently high voltage $V_{A'}$ to be applied to the auxiliary discharge anode A'. Accordingly, when the voltage $V_{AF}$ satisfying the equation (7) is applied to the relevant discharge cells, it is possible to effect the entry of picture information into the display discharge cell $DC_{ij}$. In addition, even when the voltage is not so lowered because of the little amount of diffused ionized particles, the wide range of the voltage $V_{AF}$ can be selected under the above condition $V_{KF}<O$, and hence the sufficiently large margin of the voltage of the writing pulse can be obtained. These possibilities are caused by such a feature of the driving method according to the present invention that the voltage applied to the discharge cathode is used in common for starting the auxiliary discharge and writing the picture information into the display discharge cell. Examples of measured values of the voltages $V_{KF}+V_{fpmax}$ and $V'_{fmin}$, which values are obtained as functions of the pulse width $\tau_F$ of the pulse applied to the discharge cathode, are shown in FIG. 4. The characteristic curves shown in FIG. 4, which have been measured regarding the gas-discharge display panel comprising 30×30 discharge cells, indicate that the sufficiently large margin thereof can be obtained.

The pulse width of the discharge sustaining pulse is equivalently widened by the random application of the writing pulse $V_{AF}$ to the display discharge anode A in response to the contents of picture information to be displayed, so that the dark level of the adjacent display discharge cells, which are applied with the same discharge sustaining pulse, may be raised. However, it is sufficiently possible to prevent the above raise of the dark level of those adjacent display discharge cells according to such measures as the pulse height $V_{AF}$ of the writing pulse is reduced lower than the lowest pulse voltage $V_z$ required for sustaining the gas-discharge by reducing it to the lower limit of the range given by the equation (7), as well as lower than the pulse height $V_{AS}$ of the discharge sustaining pulse. For example, by referring to the characteristic curves shown in FIG. 4, the above lowest pulse voltage $V_z$ is required to be higher than 200 volts and hence can be sufficiently higher than the lower limit of the pulse height $V_{AF}$ which is given by the equation (7). Accordingly, it is possible to sufficiently remove the injurious effect of the writing pulse $V_{AF}$ onto the discharge sustaining pulse $V_{AS}$. In addition, the display discharge cell is applied with a high voltage at the instant of the application of the writing pulse thereon, so that the dark level thereof is raised. However, as is apparent by referring to the characteristic curves shown in FIG. 4, it is possible to lower the above raised dark level by shortening the time duration during which the discharge current flows according to the certain reduction of the pulse width $\tau_F$ of the writing pulse.

The elimination of the sequence of pulse discharges in the display discharge cell for the driving method according to the present invention can be effected just similarly as for the conventional driving method, namely, by lowering the pulse height of the discharge sustaining pulse applied to the display discharge cell so as to lack at least one of the sequence of pulse discharges.

As described above, according to the driving method of the present invention, the discharge sustaining pulses and the writing pulse are individually applied to the display discharge cell independently of each other, as well as the driving pulse on the discharge cathode and the writing pulse on the display discharge anode are applied substantially at the same timing, so that it can be prevented that the voltage and the current of the pulse discharge generated in the display discharge cell exceed respectively those according to the conventional driving method, as well as the margin of the voltage height of the writing pulse can be enlarged, and further the raise of the dark level of adjacent display discharge cells, which raise is caused by the application of the writing pulse, can be reduced to the utmost.

Figure 5:
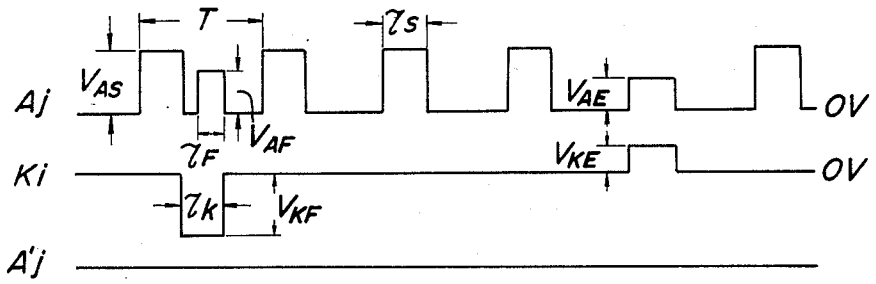
FIG. 5 is a diagram showing other examples of waveforms representing the same manner of operation.

In addition, it is apparent regarding the application of the writing pulse that the same effects as mentioned above by referring to FIG. 3 can be attained also by referring to FIG. 5. According to the driving method as shown in FIG. 5, the leading edge of the cathode driving pulse $V_{KF}$ coincides with the trailing edge of the discharge sustaining pulse $V_{AS}$, and the writing pulse $V_{AF}$ is applied to the display discharge anode somewhat later than the generation of auxiliary discharge caused by the application of the cathode driving pulse $V_{KF}$. Moreover, the same effects as mentioned above can be attained by applying the cathode driving pulse and the writing pulse at any timing between those shown in FIGS. 3 and 5.

In further addition, the same effects as mentioned above can be attained also by applying only the cathode driving pulse $V_{KF}$ to the discharge cathode $K_i$ for the entry of picture information, the trailing or the leading edge of which pulse coincides with the leading or the trailing edge of one of the discharge sustaining pulse train $V_{AS}$ respectively, and then by replacing the writing pulse $V_{AF}$ to be applied to the display discharge anode $A_j$ with the one of the discharge sustaining pulse train $V_{AS}$, which one is shifted so as a part thereof is lapped over a part of the cathode driving pulse $V_{KF}$.

In the above explanation, the current limiting resistor used conventionally for the auxiliary discharge anode has not been mentioned at all. However, it has been confirmed that any difficulty relating to the above explained operation is not caused at all by inserting the current limiting resistor for protecting the gas-discharge display panel.

Figure 6:
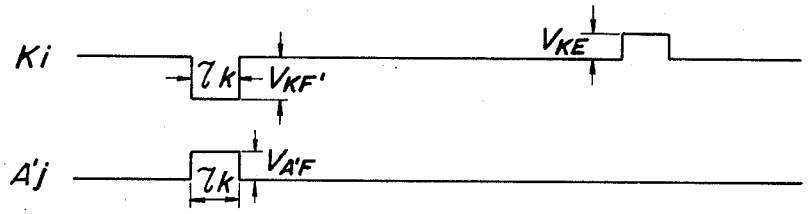
FIG. 6 is a diagram showing still other examples of waveforms representing the same manner of operation.

In such manners of operation as shown in FIGS. 3 and 5, all of the auxiliary discharge cells belonging to the same row of the matrix are arranged to generate the auxiliary gas-discharge by applying a certain constant positive voltage to the auxiliary discharge anodes of those cells, because the deviation of the delay of the start of gas-discharge can be reduced so as to accelerate the whole operation of the display panel by causing the auxiliary discharge simultaneously in plural auxiliary discharge cells less than by causing the auxiliary discharge only in one required auxiliary discharge cell. So that, these manners of operation are the most suitable for the display of television picture and the like for which the high speed entry of picture information is required. However, it is also possible that the auxiliary discharge is caused only in the auxiliary discharge cell $AC_{ij}$ which is arranged at the crosspoint of the discharge cathode $K_i$ and the auxiliary discharge anode $A'_j$ by separating the cathode driving pulse voltage $V_{KF}$ into two parts $V_{KF'}$ and $V_{A'F}$ as shown in FIG. 6 which are applied to the discharge cathode $K_i$ and the auxiliary discharge anode $A'_j$, so as to satisfy the following condition.

$$V_{A'F}-V_{KF'}>V_{fs},\ |V_{KF'}|<V_{fs},\ |V_{A'F}|<V_{fs}$$

where $V_{fs}$ is the discharge starting voltage of the auxiliary discharge cell. In addition, it is also possible that the load impressed on the driving circuit is reduced by separating the discharge sustaining pulse voltage into two parts between the display discharge anode $A_j$ and the discharge cathode $K_i$. Furthermore, in the above explanation, the potentials of the display discharge anode and the discharge cathode are set up to zero volt when the writing pulse and the cathode driving pulse are not applied to those electrodes respectively. However, these potentials are not necessary to be restricted only to this example, but can be set up to another appropriate value, so as to obtain the same effect.

Figure 7:
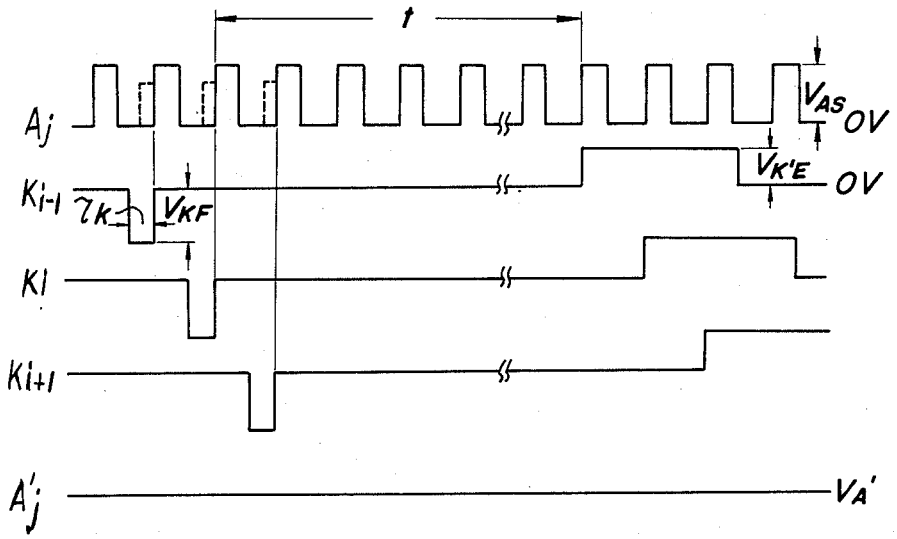
FIG. 7 is a diagram showing the most preferable examples of waveforms representing the same manner of operation.

A preferred example of the method for driving the gas-discharge display panel according to the present invention is shown in FIG. 7. Regarding waveforms shown in FIG. 7, the cathode driving pulse $V_{KF}$ is applied successively to each of the discharge cathodes $K_{i-1}$, $K_i$, $K_{i+1}$ on each rows of the matrix from the top thereof, so as to successively cause the auxiliary discharge between those cathodes and the auxiliary discharge anode $A_j'$ for scanning the matrix from the top to the bottom thereof. In this scanning of the matrix, the building-up of the auxiliary discharge can be accelerated, because each of auxiliary discharge cell are kept in such a state as the gas-discharge can be easily caused by the immediately preceding gas-discharge effected in the adjacent auxiliary discharge cell, and hence the time duration required for the entry of picture information into the display discharge cell can be shortened.

Although it is not shown in FIG. 7, it is also possible to accelerate the building-up of the auxiliary discharge caused in the top row of the matrix by applying a wide negative driving pulse to another discharge cathode for resetting the sequence of auxiliary discharges which is separated from the display discharge cell.

In the embodiment shown in FIG. 7, a sufficiently high positive eliminating pulse having a sufficiently wide pulse width is applied only to the discharge cathodes $K_{i-1}$, $K_i$, $K_{i+1}$, so as to eliminate the sequence of pulse discharges in the display discharge cell only by virtue of this eliminating pulse, and, as a result, the further simplification of the driving circuit can be attained. That is, the sequence of pulse discharges, which has been started by the entry of picture information into the display discharge cell, is eliminated after the time duration t corresponding to the brightness required for the relevant picture element is expired, as shown in FIG. 7.

According to the above described driving method, it is possible to display the characters and the like with a sufficiently high brightness, as well as to reduce the time duration required for the entry of picture information shorter than 10 μsec, so that it is also possible to display a bright picture containing plural steps of intermediate brightness by varying the time duration t of the sequence of pulse display discharges sustained by the discharge sustaining pulse train. For example, a television picture having a maximum to minimum brightness ratio being equal to 60 to 1 can be obtained by employing the writing pulse having the most suitable pulse width $\tau_F$.

In the above explanation, the common discharge electrode, which is used for the display discharge cell and the auxiliary discharge cell in common, is operated as the discharge cathode. However, when the common discharge electrode is operated as the discharge anode, as well as the polarity of the voltage applied to the common discharge electrode is reversed at the same time, it is natural that the same effect as mentioned above can be attained. On the other hand, even if the gas-discharge display panel does not comprise the discharge cathode provided with a hole formed for ionized coupling, it is also natural that the same effect as mentioned above can be attained by adopting the driving method of the present invention, so long as the auxiliary discharge cell and the display discharge cell are coupled with each other through the ionization in the gas-discharge display panel.

According to the aforesaid conventional driving method, the writing pulse is applied in the same phase with the discharge sustaining pulse, so that this conventional method is remarkably different from the driving method of the present invention in respect that the dark level of the adjacent display discharge cells is raised, and that the margin of the possible range of the writing pulse voltage cannot be enlarged so sufficiently, because the cathode driving pulse is not operated so efficiently as according to the present invention.

As is apparent from the above explanation, according to the present invention, the cathode driving pulse is used in common for the start of the auxiliary discharge and for the entry of picture information into the display discharge cell, so that it is possible to enlarge the range of the writing pulse voltage to be applied to the display discharge cell, and hence to effect the entry of picture information stably and exactly, as well as the dark level of the adjacent display discharge cells can be lowered by reducing the pulse height of the writing pulse. In addition, the discharge sustaining pulse applied to the display discharge anode can be used exclusively for sustaining the sequence of pulse discharges, so that it is possible to sustain the gas-discharge by the pulse voltage and current being less than those of the conventional discharge sustaining pulse, and hence to reduce the power consumption extremely less than that in the conventional gas-discharge display panel, as well as to elongate the life of the display panel and the driving circuit extremely longer than that of the conventional display panel. Moreover, in the situation where the fluorescent material is used for the display, the efficiency of the radiation thereof is remarkably increased at the small discharge current, so that it is very advantageous that it is possible according to the present invention to drive the gas-discharge display panel with the small discharge current.

In the preferred embodiment of the present invention, the display panel is scanned by the auxiliary discharge, so that it is possible to accelerate the entry of picture information thereinto, and further the bright display of characters and the like on the large display panel can be facilitated as well as the television picture.

Conclusively speaking, it is possible according to the present invention that the entry of picture information into the gas-discharge display panel is effected stably and exactly and that characters and pictures are displayed by the bright and efficient pulse gas-discharges.

What is claimed is:

1. A method for driving a gas-discharge display panel comprising:

selecting a gas-discharge display panel having a matrix of pairs of display discharge cells and auxiliary discharge cells with each pair having at least a display discharge cells with each pair having at least a display discharge electrode and an auxiliary discharge electrode with a common discharge electrode disposed between said display and auxiliary discharge electrode, said common discharge electrode having a hole therein which provides for ionized coupling between the display discharge cell and the auxiliary discharge cell;

applying a discharge sustaining pulse train to said display discharge electrode, said discharge sustaining pulse train having pulses with a pulse height and a pulse width and an interval between pulses sufficient to sustain a display gas-discharge upon initiation of said display gas-discharge; and applying a discharge initiating pulse voltage and a discharge eliminating pulse voltage between the electrodes of said display discharge cell and auxiliary discharge cell to initiate and terminate a display respectively, said discharge initiating pulse voltage consisting of a pair of voltage pulses of opposite polarities one of which is applied to the display discharge electrode and the other of which is applied successively to each of the common discharge electrodes on each of the rows of the matrix at an interval equal to the interval between pulses of the discharge sustaining pulse train with the continuous application of a DC voltage to the auxiliary discharge electrode during the interval between pulses of the discharge sustaining pulse train so that the auxiliary gas-discharge is generated at one time in all of the auxiliary discharge cells belonging to the same row of the matrix, said DC voltage having a polarity opposite to said voltage pulse applied to said common electrodes and said pair of voltage pulses having pulse widths such that the trailing edges of said pair of voltage pulses coincide with one another and with the leading edge of a subsequent discharge sustaining pulse and hence do not overlap the pulses of the discharge sustaining pulse train, said one of said pair of voltage pulses applied to the display discharge electrode having a pulse height which does not exceed the height of the discharge sustaining pulse and a pulse width which does not exceed the other of said pair of voltage pulses applied to the common discharge electrode, and wherein $V_{fmin} > V_{AS} > V_{zmax}$ where $V_{AS}$ is the height of the discharge sustaining pulse, $V_{fmin}$ is the lowest voltage among all of the gas-discharge cells of the discharge starting pulse voltage, and $V_{zmax}$ is the highest voltage among all of the gas-discharge cells of the lowest pulse voltage $V_z$ required individually for sustaining pulse discharges in the display discharge cells.

2. The method for driving a gas-discharge display panel of claim 1 wherein the display discharge and auxiliary discharge electrodes are anodes and the common discharge electrode is a cathode and wherein said pair of voltage pulses of said discharge initiating pulse voltage includes a negative driving pulse $V_{KF}$ applied to said cathode and a positive writing pulse $V_{AF}$ applied to said display discharge anode during the interval between the pulses of the discharge sustaining pulse train and further including the step of applying a continuous positive voltage to said auxiliary discharge anode wherein $$V_{KF}+V_{fpmax}<V_{AF}<V_{fmin} \text{ and } V_{KF}<V_{fpmin}$$

where $V_{fmin}$ is the lowest voltage of the discharge starting voltage of the display discharge cell among all of the gas-discharge cells and $V_{fpmax}$ and $V_{fpmin}$ the highest and lowest voltages, respectively, of the discharge starting voltage of the display discharge cell among all of the gas-discharge cells during auxiliary cell discharge.

3. The method of driving a gas-discharge display panel of claim 2 wherein said driving pulse voltage $V_{KF}$ is defined by a negative pulse portion $V_{KF}$ applied to the discharge cathode and a positive voltage pulse $V_{A'F}$ applied to said auxiliary discharge anode $A'_j$ coincident with said negative pulse portion $V_{KF}$ to cause auxiliary discharge only in the auxiliary discharge cell $AC_{ij}$ and wherein $$V_{A'F}-V_{KF}>V_{fs},\ |V_{KF}|<V_{fs},\ |V_{A'F}|<V_{fs}$$

where $V_{fs}$ is a discharge initiating voltage of the auxiliary discharge cell.

4. The method for driving a gas-discharge display panel of claim 2 further comprising the step of applying a discharge eliminating pulse of sufficient positive height and width to said discharge cathode.

5. The method for driving a gas-discharge display panel of claim 1 further comprising the step of applying a wide negative driving pulse to a discharge electrode separated from the display discharge cell in the top row of the matrix for resetting the sequence of auxiliary discharges.

6. A method for driving a gas-discharge display panel comprising:

selecting a gas-discharge display panel having a matrix of pairs of display discharge cells and auxiliary discharge cells with each pair having at least a display discharge electrode and an auxiliary discharge electrode with a common discharge electrode disposed between said display and auxiliary discharge electrode, said common discharge electrode having a hole therein which provides for ionized coupling between the display discharge cell and the auxiliary discharge cell;

applying a discharge sustaining pulse train to said display discharge electrode, said discharge sustaining pulse train having pulses with a pulse height and a pulse width and an interval between pulses sufficient to sustain a display gas-discharge upon initiation of said display gas-discharge; and applying a discharge initiating pulse voltage and a discharge eliminating pulse voltage between the electrodes of said display discharge cell and auxiliary discharge cell to initiate and terminate a display respectively, said discharge initiating pulse voltage consisting of a pair of voltage pulses of opposite polarities one of which is applied to the display discharge electrode and the other of which is applied to the common discharge electrode with the continuous application of a DC voltage to the auxiliary discharge electrode during the interval between pulses of the discharge sustaining pulse train, said DC voltage having a polarity opposite to said voltage pulse applied to said common discharge electrode and said pair of voltage pulses having pulse widths such that the trailing edges of said pair of voltage pulses coincide with one another and with the leading edge of a subsequent discharge sustaining pulse and hence do not overlap the pulses of the discharge sustaining pulse train, said one of said pair of voltage pulses applied to the display discharge electrode having a pulse height which does not exceed the height of the discharge sustaining pulse and a pulse width which does not exceed the other of said pair of voltage pulses applied to the common discharge electrode, and wherein $V_{fmin} > V_{AS} > V_{zmax}$ where $V_{AS}$ is the height of the discharge sustaining pulse, $V_{fmin}$ is the lowest voltage among all of the gas-discharge cells of the discharge starting pulse voltage, and $V_{zmax}$ is the highest voltage among all of the gas-discharge cells of the lowest pulse voltage $V_z$ required individually for sustaining pulse discharges in the display discharge cells.

* * * * *